US006079710A

United States Patent [19]

Brown

[11] Patent Number: 6,079,710

[45] Date of Patent: Jun. 27, 2000

[54] EDUCATIONAL NUMBER GAME

[76] Inventor: Beatrice T. Brown, SE. 1440 Cole Rd., Shelton, Wash. 98584

[21] Appl. No.: 09/082,682

[22] Filed: May 21, 1998

[51] Int. Cl.[7] ..... A63F 3/00

[52] U.S. Cl. ..... 273/269; 434/188; 434/129

[58] Field of Search ..... 273/269; 434/128, 434/129, 188, 191, 209

[56] References Cited

U.S. PATENT DOCUMENTS 2,769,640 11/1956 Elder .
3,545,101 12/1970 Fike .
3,549,150 12/1970 Weeks .
3,602,513 8/1971 Breen .
3,777,415 12/1973 Gariety .
5,011,157 4/1991 Lovell .
5,458,338 10/1995 Beardsley .

*Primary Examiner*—William M. Pierce

[57] ABSTRACT

A value bingo-type game is provided including a plurality of player boards each having a matrix of squares situated thereon. The matrix has a plurality of columns each with a unique color and a plurality of squares each with a number within a predetermined range. Next provided is a plurality of tokens. A set of caller cards is included each indicative of one of the numbers of the boards, wherein each of the caller cards has one of the colors printed thereon.

1 Claim, 3 Drawing Sheets

EDUCATIONAL NUMBER GAME

BACKGROUND OF THE INVENTION

1. Field of the Invention

The present invention relates to numeric card games and more particularly pertains to a new educational number game for providing an educational bingo-type value game.

2. Description of the Prior Art

The use of numeric card games is known in the prior art. More specifically, numeric card games heretofore devised and utilized are known to consist basically of familiar, expected and obvious structural configurations, notwithstanding the myriad of designs encompassed by the crowded prior art which have been developed for the fulfillment of countless objectives and requirements.

Known prior art numeric card games include U.S. Pat. No. 5,033,754; U.S. Pat. No. 4,281,835; U.S. Pat. No. 2,320,832; U.S. Pat. No. 4,940,240; U.S. Pat. No. 5,242,171; and U.S. Pat. No. Design 291,330.

In these respects, the educational number game according to the present invention substantially departs from the conventional concepts and designs of the prior art, and in so doing provides an apparatus primarily developed for the purpose of providing an educational bingo-type value game.

SUMMARY OF THE INVENTION

In view of the foregoing disadvantages inherent in the known types of numeric card games now present in the prior art, the present invention provides a new educational number game construction wherein the same can be utilized for providing an educational bingo-type value game.

The general purpose of the present invention, which will be described subsequently in greater detail, is to provide a new educational number game apparatus and method which has many of the advantages of the numeric card games mentioned heretofore and many novel features that result in a new educational number game which is not anticipated, rendered obvious, suggested, or even implied by any of the prior art numeric card games, either alone or in any combination thereof.

To attain this, the present invention generally comprises a plurality of player boards each having a square matrix of squares situated thereon. It should be noted that the matrix has a plurality of columns each with a unique color. The squares of each columns further have plurality of squares each with a randomly selected, unique number between 0–10. FIG. 1 shows a caller board having a matrix of squares situated thereon. The matrix of the caller board has a plurality of columns each with a unique color and a plurality of squares each with a unique number between 0–10. The numbers of the squares of each column are positioned in sequence from top to bottom. It should be noted that the sequence of colors of the columns of the caller board is similar to that of the player boards. As shown in FIG. 3, a plurality of disk-shaped tokens are provided each of a common color, size and shape. FIG. 4 depicts a first set of caller cards. Each of the caller cards includes English alphabetic characters which are printed in one of the colors of the boards. Further, the English alphabetic characters are indicative of one of the numbers of the boards. Associated therewith is a second set of caller cards each including foreign alphabetic characters having one of the colors of the boards and being indicative of one of the numbers of the boards. Note FIG. 5. As shown in FIG. 6, a third set of caller cards is provided each including numeric characters in the form of an equation. Such equation is printed in one of the colors of the boards. It should be noted that the equation has an associated mathematical solution.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. Tile invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new educational number game apparatus and method which has many of the advantages of the numeric card games mentioned heretofore and many novel features that result in a new educational number game which is not anticipated, rendered obvious, suggested, or even implied by any of the prior art numeric card games, either alone or in any combination thereof.

It is another object of the present invention to provide a new educational number game which may be easily and efficiently manufactured and marketed.

It is a further object of the present invention to provide a new educational number game which is of a durable and reliable construction.

An even further object of the present invention is to provide a new educational number game which is susceptible of a low cost of manufacture with regard to both materials and labor, and which accordingly is then susceptible of low prices of sale to the consuming public, thereby making such educational number game economically available to the buying public.

Still yet another object of the present invention is to provide a new educational number game which provides in the apparatuses and methods of the prior art some of the advantages thereof, while simultaneously overcoming some of the disadvantages normally associated therewith.

Still another object of the present invention is to provide a new educational number game for providing an educational bingo-type value game.

Even still another object of the present invention is to provide a new educational number game that includes a plurality of player boards each having a matrix of squares situated thereon. The matrix has a plurality of columns each with a unique color and a plurality of squares each with a number within a predetermined range. Next provided is a plurality of tokens. A set of caller cards is included each indicative of one of the numbers of the boards, wherein each of the caller cards has one of the colors printed thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
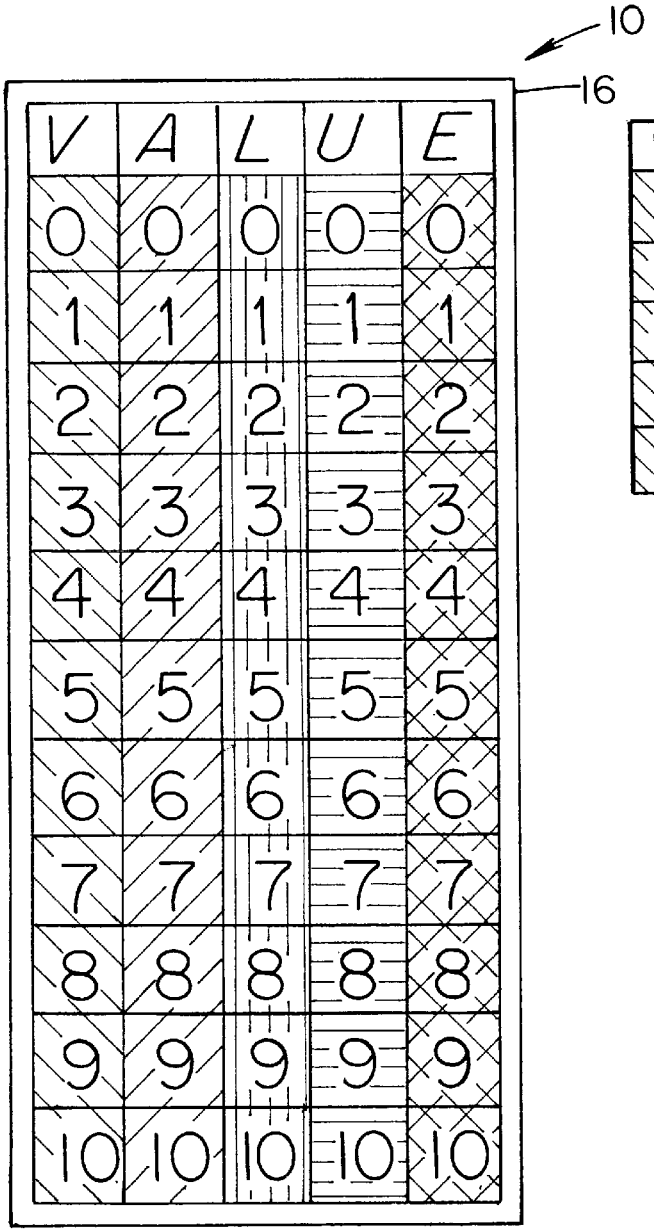
FIG. 1 is a top view of the caller board of the present invention.
Figure 2:
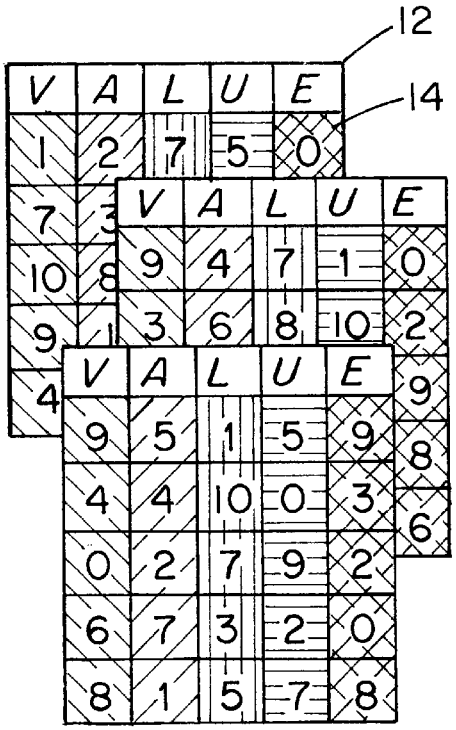
FIG. 2 is a top view of the player boards of the present invention.

With reference now to the drawings, and in particular to FIGS. 1 through 8 thereof, a new educational number game embodying the principles and concepts of the present invention and generally designated by the reference numeral 10 will be described.

The present invention, designated as numeral 10, includes a plurality of player boards 12 each having a square matrix of squares 14 situated thereon. It should be noted that the matrix has a plurality of columns each with a unique color. The squares of each column further have plurality of squares each with a randomly selected, unique number between 0–10.

Figure 3:
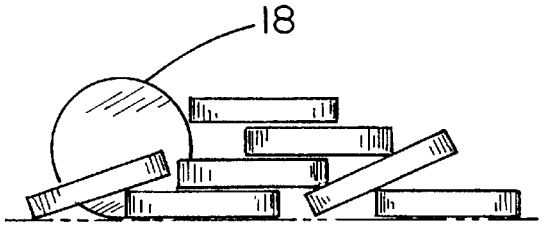
FIG. 3 is an illustration of the tokens of the present invention.

FIG. 1 shows a caller board 16 having a matrix of squares situated thereon. The matrix of the caller board has a plurality of columns each with a unique color and a plurality of squares each with a unique number between 0–10. The numbers of the squares of each column are positioned in sequence from top to bottom. It should be noted that the sequence of colors of the columns of the caller board is similar to that of the player boards. As shown in FIG. 3, a plurality of disk-shaped tokens 18 are provided each of a common color, size and shape.

Figure 4:
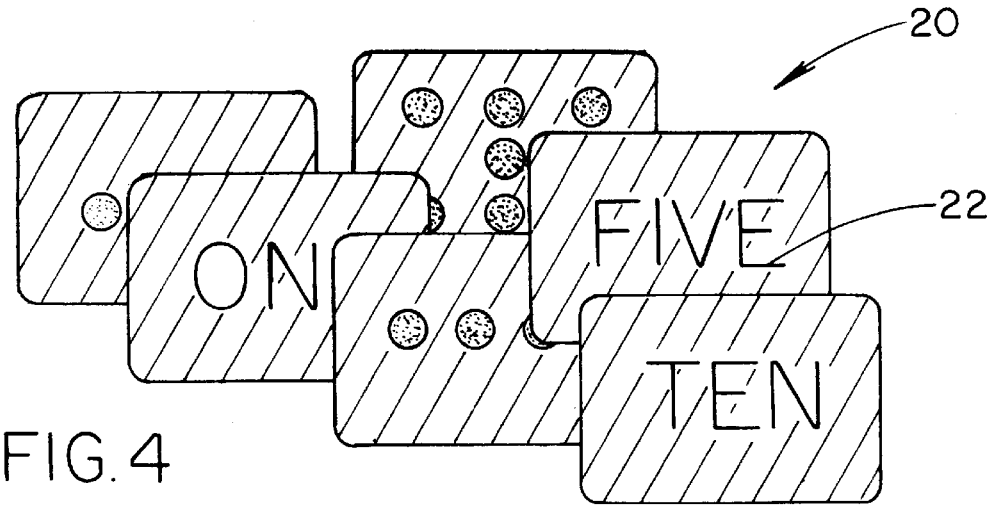
FIG. 4 is a top view of the first set of caller cards of the present invention.
Figure 5:
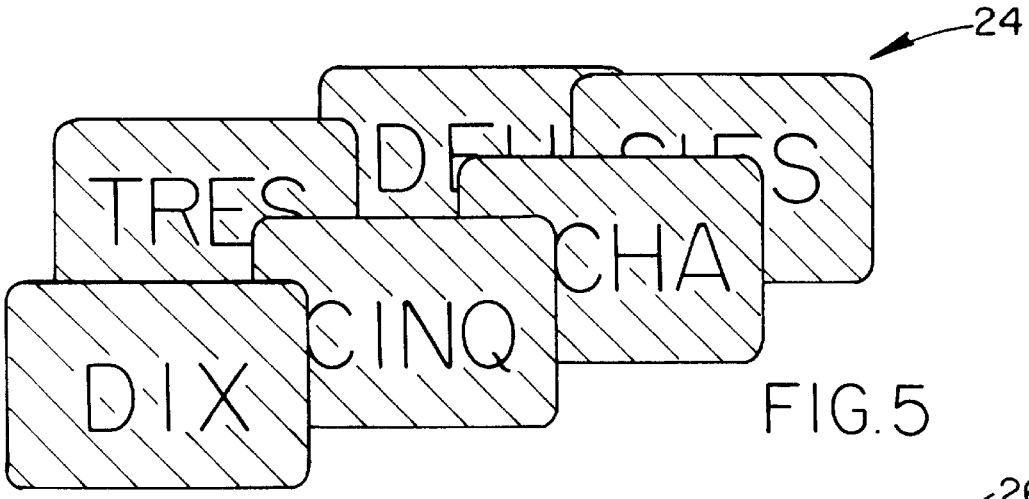
FIG. 5 is a top view of the second set of caller cards of the present invention.

FIG. 4 depicts a first set of caller cards 20. Each of the caller cards includes English alphabetic characters 22 which are printed in one of the colors of the boards. Further, the English alphabetic characters take the form of a word which is indicative of one of the numbers of the boards.

Associated therewith is a second set of caller cards 24 each including foreign alphabetic characters in the form of a word having one of the colors of the boards and being indicative of one of the numbers of the boards. Note FIG. 5.

Figure 6:
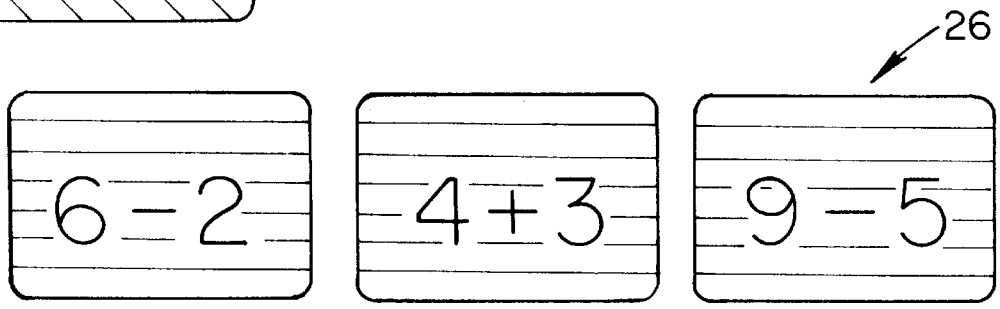
FIG. 6 is a top view of the third set of caller cards of the present invention.
Figure 6:
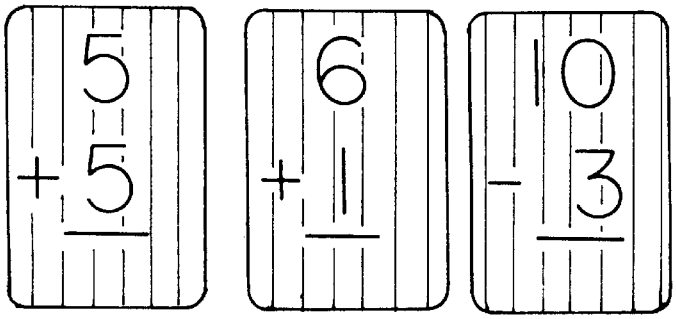
Figure 7:
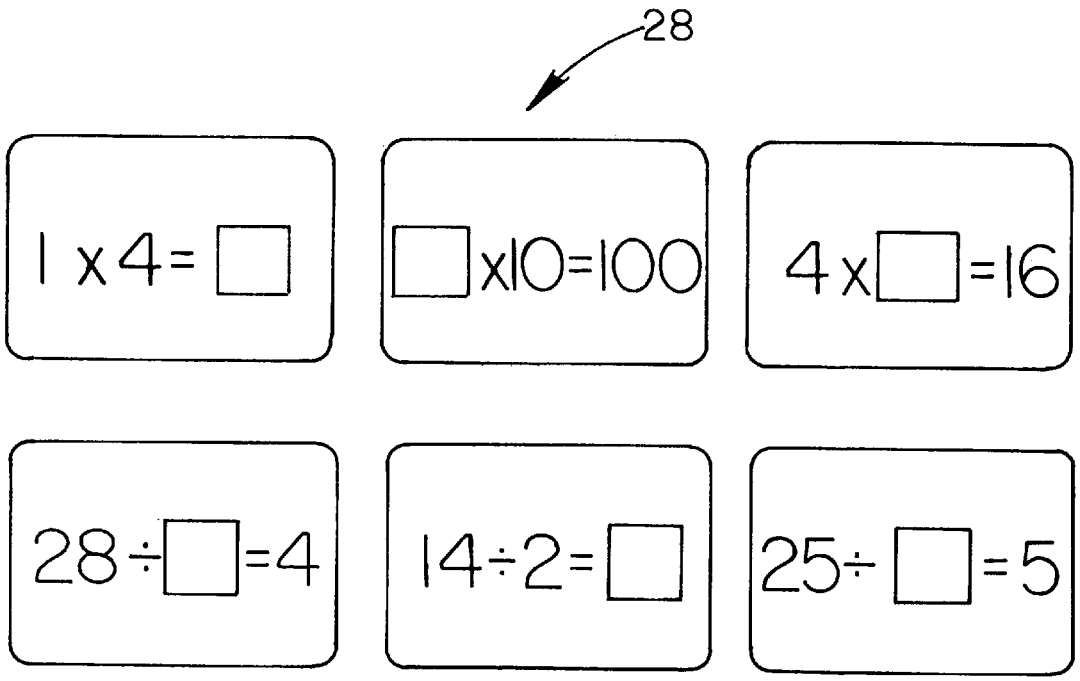
FIG. 7 is a top view of the fourth set of caller cards of the present invention.
Figure 8:
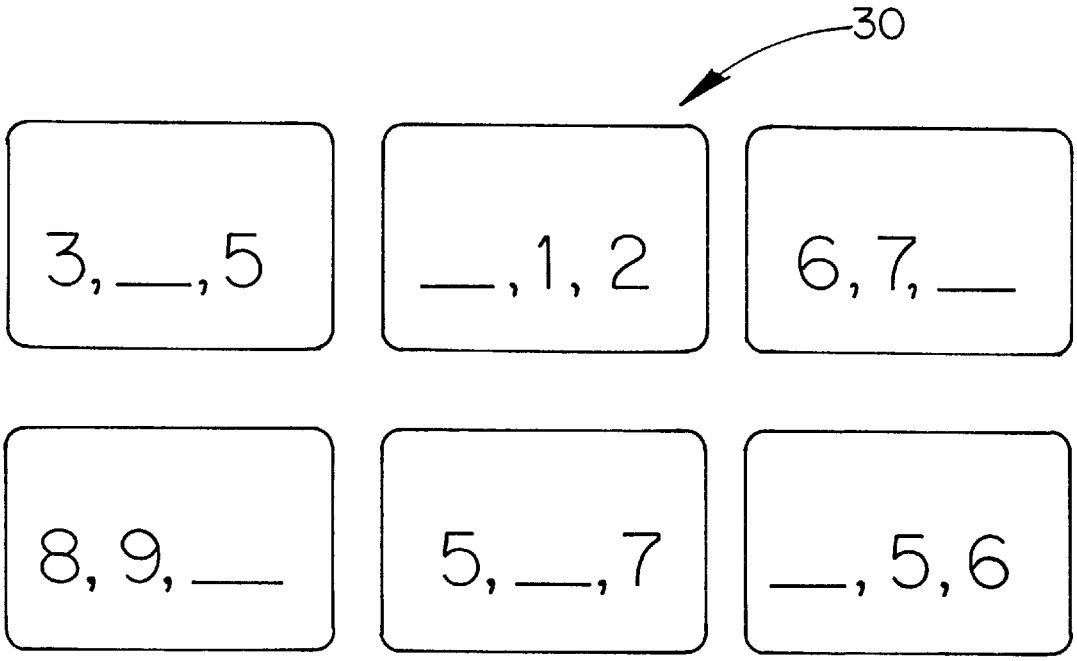
FIG. 8 is a top view of the fifth set of caller cards of the present invention.

As shown in FIG. 6, a third set of caller cards 26 is provided each including numeric characters in the form of an equation. Such equation is printed in one of the colors of the boards. It should be noted that the equation has an associated mathematical solution. It should also be noted that the equation may be situated either horizontally or vertically. Further, the number which the equation represents may take the form of the sum or difference of two added or subtracted numbers, respectively. In a fourth set of caller cards 28, the number may take the form of a number to be multiplied or divided by another given number to render a given product or quotient, respectively. Note FIG. 7.

Finally, a fifth set of calling cards 30 is provided including numeric characters each having one of the colors of the boards. Further, the numeric characters take the form of a sequence, wherein a number missing from the sequence is one of those of the boards.

The method associated with the present invention will now be set forth. Play starts only after a caller is designated and is provided with the caller board and a plurality of tokens. Each of a plurality of players are provided with multiple tokens and at least one of the player boards. Next, the caller cards are drawn one-by-one by the caller. Upon the drawing of each caller card, the caller verbally recites the color of the card and further the indica that is shown thereon. Thereafter, one of the players is picked to recite the number that the indica on the caller card represents.

It should be noted that this recitation is only necessary when the indica is in the form of foreign alphabetic letters or an equation. Further, it should be understood that the recitation of the color is critical in providing a visual means of differentiating between the columns of the player cards as opposed to an alphabetic letter which, in combination with the equation or foreign word, overly complicates the game.

At this time, each of the players places a token on one of the squares of his or her playing board if the number associated with the caller card is in a square which resides in column of the color associated with the caller card which is called out. The caller does the same on the caller board for tracking which cards have been picked. A winner is declared as a person who has a complete row, column or diagonal of squares filled with tokens. As an option, other configurations of tokens may be attempted. The winner is then designated as the caller and the game is repeated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, forming, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A value bingo-type game comprising, in combination:

a plurality of player boards each having a square matrix of squares situated thereon, the matrix having a plurality of columns each with a unique color and a plurality of squares each with a unique number between 0–10;

a caller board having a matrix of squares situated thereon, the matrix having a plurality of columns each with a unique color and a plurality of squares each with a unique number between 0–10, wherein the numbers of the squares of each column are positioned in sequence from top to bottom, wherein the sequence of colors of the columns of tile caller board is similar to that of the player boards;

a first set of caller cards each including English alphabetic characters having one of the colors of the boards and being indicative of one of the numbers of the boards;

second set of caller cards each caller card of the second set including foreign alphabetic characters having one of the colors of the boards different than the color of the first set of caller cards and being indicative of one of the numbers of the boards wherein a player must translate the foreign alphabetic characters to determining the number indicated by the associated caller card of the second set;

a third set of caller cards, each caller card of the third set including numeric characters in the form of an equation and having one of the colors of the boards different than the colors of the first and second set of caller cards, wherein the equation has an associated mathematical solution equivalent to one of the numbers of the boards, wherein a player must determine the mathematical solution to determine the number indicated by the associated caller card of the third set; and a plurality of disk-shaped tokens each of a common color, size and shape for covering a called number determined by the associated number and color of each of said first second and third set of caller cards.

* * * * *